US006968584B1

(12) United States Patent
Laflèche

(10) Patent No.: US 6,968,584 B1
(45) Date of Patent: Nov. 29, 2005

(54) FOOT END LATCH MECHANISM

(75) Inventor: Patrick Laflèche, Lévis (CA)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 10/903,282

(22) Filed: Jul. 30, 2004

(51) Int. Cl.[7] ..... A61G 7/015; A61G 7/05
(52) U.S. Cl. ..... 5/618; 5/613
(58) Field of Search ..... 5/613, 600, 618, 5/624, 661

(56) References Cited

U.S. PATENT DOCUMENTS

| | | | |
|---|---|---|---|
| 3,304,116 | A | 2/1967 | Stryker |
| 6,230,343 | B1 | 5/2001 | Buiskool et al. |
| 6,264,006 | B1 | 7/2001 | Hanson et al. |
| 2003/0159215 | A1 | 8/2003 | Shiery et al. |

*Primary Examiner*—Alexander Grosz
(74) *Attorney, Agent, or Firm*—Flynn, Thiel, Boutell & Tanis, P.C.

(57) ABSTRACT

A patient support apparatus which includes an elongate frame on which is reciprocally mounted a patient support deck that includes a head section, a seat section and a foot section. The foot section includes first and second sections. A hinge assembly is provided for pivotally supporting the first section for movement to and between a generally horizontal position and a generally vertical position. An extendable and retractable track assembly is provided on the first section for supporting the second section for movement between an extended position wherein said foot section has a longest dimension and retracted position wherein the foot section has a shortest dimension. A latch mechanism is configured to latch the second section to the first section and includes a floor engaging latch release mechanism configured to effect an unlatching of the latch mechanism in response to an engagement thereof with a floor surface. The latch mechanism also includes a handle mechanism configured to facilitate a manual release of the latch mechanism.

16 Claims, 9 Drawing Sheets

FOOT END LATCH MECHANISM

FIELD OF THE INVENTION

This invention relates to a patient support apparatus and, more particularly, to a patient support apparatus having a foot section that is hingeably supported for movement between a generally horizontal position for supporting a patient and a generally vertical position. The foot section includes a first section which is extendable and retractable with respect to another second section. A latch mechanism is provided on the foot section and is configured to latch the first section to the second section and become unlatched in response to the latch mechanism engaging the floor when the foot section is moved to the generally vertical position. A manual override is provided for the latch to facilitate lengthening and shortening of the foot section when the foot section is in the generally horizontal position.

BACKGROUND OF THE INVENTION

Wheeled carriages for supporting a patient in a substantially horizontal position are well known in the art and a representative example of an early version of such a device is illustrated in Dr. Homer H. Stryker's U.S. Pat. No. 3,304,116, reference to which is incorporated herein. Other such wheeled carriages are disclosed in U.S. Pat. Nos. 6,230,343 and 6,264,006, both of which are presently owned by the Assignee of record for this invention. The subject matter of these latter two patents is also to be incorporated herein by reference. The subject matter of pending application U.S. Ser. No. 10/083,234, filed on Feb. 26, 2002, presently owned by the Assignee of record for this application, is also to be incorporated herein by reference.

In some instances of patient care, it is desirable to facilitate the exit of a patient from the foot end of the bed. In order to facilitate this type of bed exit, it is an object of the invention to provide a patient support apparatus, as aforesaid, which is free of actuators directly connected to and associated with the foot section.

It is a further object of the invention to provide a patient support apparatus, as aforesaid, wherein the lengthening and shortening feature includes a latch mechanism that locks the foot section in selected positions of and between the fully extended position and the fully retracted position and includes a latch release mechanism that is manually operable as well as operable in response to an engagement thereof with a floor surface on which the patient support apparatus is supported in order to effect a release of the latching mechanism and facilitating a shortening of the foot section.

SUMMARY OF THE INVENTION

The objects and purposes of the invention are met by providing a patient support apparatus which includes an elongate frame having a head end, a foot end and lateral sides. A patient support deck is mounted on the frame and includes a head section, a seat section and a foot section. The foot section includes first and second sections. A hinge assembly is provided for pivotally supporting the first section for movement to and between a generally horizontal position and a generally vertical position. An extendable and retractable track assembly is provided on the first section for supporting the second section for movement between an extended position wherein said foot section has a longest dimension and retracted position wherein the foot section has a shortest dimension. A latch mechanism is configured to latch the second section to the first section and includes a floor engaging latch release mechanism configured to effect an unlatching of the latch mechanism in response to an engagement thereof with a floor surface and to enable a relative movement between the first and second sections as the foot section transitions between the aforesaid generally horizontal position and the generally vertical position. The latch mechanism also includes a handle mechanism configured to facilitate a release of the latch mechanism in response to a manual manipulation of the handle mechanism and when the floor engaging latch release mechanism is out of engagement with the floor surface.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
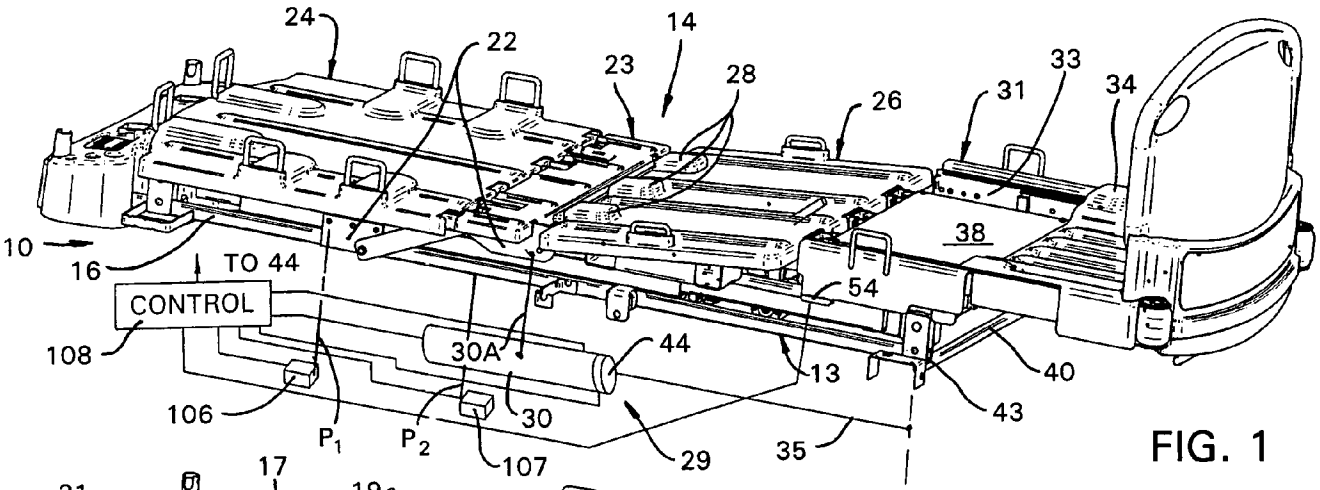
FIG. 1 is an isometric view of a patient support deck embodying the invention.

Certain terminology will be used in the following description for convenience in reference only, and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

Figure 2:
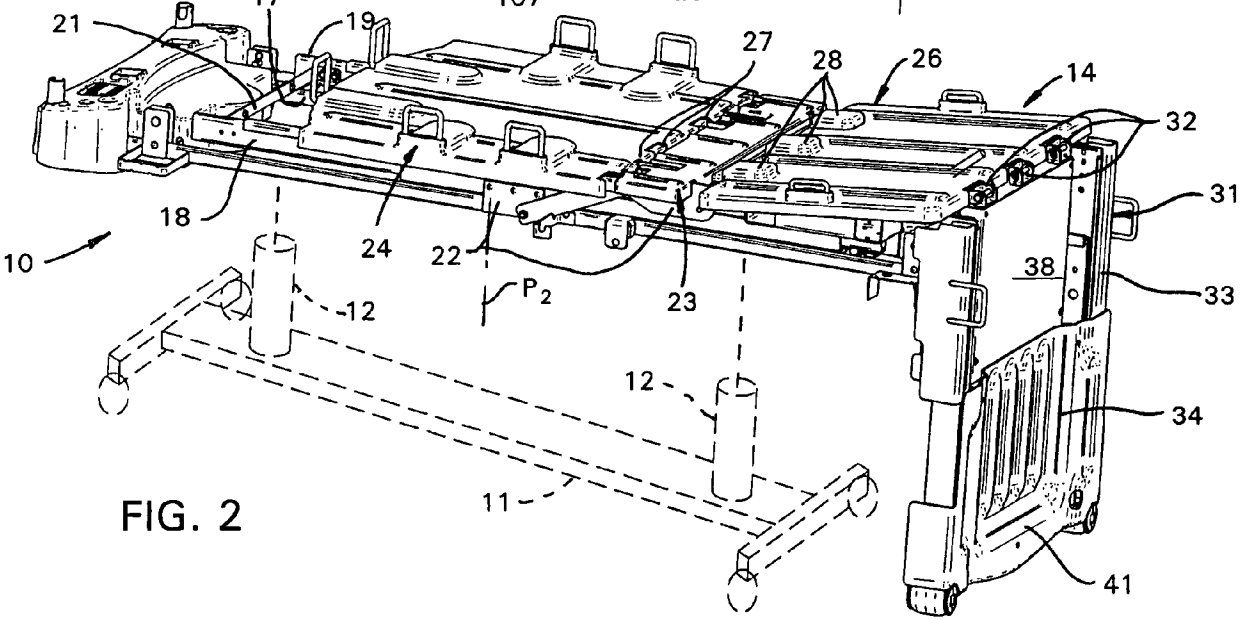
FIG. 2 is a view similar to FIG. 1, but illustrating the patient support deck mounted on a wheel supported base and being shifted to the right.

FIGS. 1 and 2 illustrate a patient support apparatus 10 embodying the invention. The patient support apparatus 10 includes a wheel supported base 11 on which is provided a pair of actuators 12 for raising and lowering a frame 13 on which is supported a patient support deck 14. In FIG. 2, the actuators 12 are illustrated as hydraulic jacks. One example of a base 11 is illustrated in pending application Ser. No. 10/083,234, filed Feb. 26, 2002. Another example of a suitable base using electric motors as the actuators for effecting elevation changes is disclosed pending application Ser. No. 10/902,519, filed on Jul. 29, 2004. The aforementioned disclosures are incorporated herein by reference.

The frame 13 includes a pair of elongate bars 16 and 17 extending parallel to one another lengthwise of the bed. Plural crosswise extending bars (not illustrated) interconnect the elongate bars 16 and 17 at frequent intervals along the length of the elongate bars 16 and 17. Support brackets (not illustrated) are mounted on the crosswise extending bars and mount to the reciprocal rods of the actuators 12 in a well known and conventional manner. A pair of elongate guide rails 18 and 19 are supported on and above the frame 13 and extend lengthwise of the bed. Crosswise extending braces 21 interconnect the guide rails 18 and 19 along the lengths thereof.

A carriage 22 is mounted for reciprocal movement on the guide rails 18 and 19. The patient support deck 14 is supported on the carriage 22 and for movement therewith. More specifically, the patient support deck 14 includes a seat section and/or a seat and thigh section 23 mounted on the carriage 22 and adjacent to which is oriented a head section 24 on one side thereof and a foot section 31 on the opposite side thereof. The thigh section of the seat section 23 is indicated by the reference numeral 26. The hinges connecting the head section 24 to the carriage 22 are illustrated at 27 whereas the seat section 23 and the thigh section 26 are interconnected to the carriage 22 and the thigh section 26 is hinged to the carriage 22 by hinges illustrated at 28. A not illustrated actuator mounted on the carriage 22 is provided for moving the head section 24 relative to the seat section 23 about the hinges 27.

A first driver or actuator assembly 29 (FIGS. 1 and 13) is oriented beneath the patient support deck 14, particularly beneath the carriage 22 on which the seat and thigh section 23 is mounted and between the guide rails 18 and 19 oriented beneath the seat and thigh section 23 and the foot section 31 when it is oriented in a horizontal plane. In this embodiment, the driver housing 30 is fixed to a cross brace 40 secured to and extending between the foot ends 43 of the guide rails 18 and 19 oriented beneath the foot section 31 when it is oriented in the horizontal plane. The reciprocal driven member 35 projecting from the housing 30 is fixed, as schematically indicated at 30A in FIG. 1, to the underside of the carriage 22. The actuator or driver assembly 29 includes an elongation sensor 44 that monitors the position of the carriage 22 relative to the driver housing 30 and communicates that position to a control 108.

The foot section 31 of the patient support deck 14 is hingedly secured to the foot end of the thigh section 26 of the seat section 23 by plural hinges 32. A second actuator or driver assembly 45 (FIG. 13) is oriented beneath the patient support deck 14, particularly beneath the seat and thigh section 23 and the foot section 31. In this embodiment, the driver housing 50 of the actuator or driver assembly 45 is pivotally secured, as schematically indicated at 45A in FIG. 13, to the underside of the foot section 31 adjacent at least one of the hinges 32. The reciprocal driven member 53 projecting from the driver housing 50 is fixed to the underside of the seat and thigh section 23. As a result, the foot section 31 is cantilevered from the foot end of the seat and thigh section 23 and spaced above the guide rails 18 and 19 a finite distance. The actuator assembly 45 includes an inclinometer 54 that monitors the angle position of foot section 31 relative to the horizontal and communicates that angle position to the control 108. The control 108 is configured to coordinate the elongation sensor signals from the elongation sensor 44 and the signals from the inclinometer in a way to assure a limited actuation of the actuator 45 to prevent interference between the foot ends 43 of the guide rails 18 and 19 and the foot section 31 as the foot section is pivoted above the hinges 32.

Figure 10:
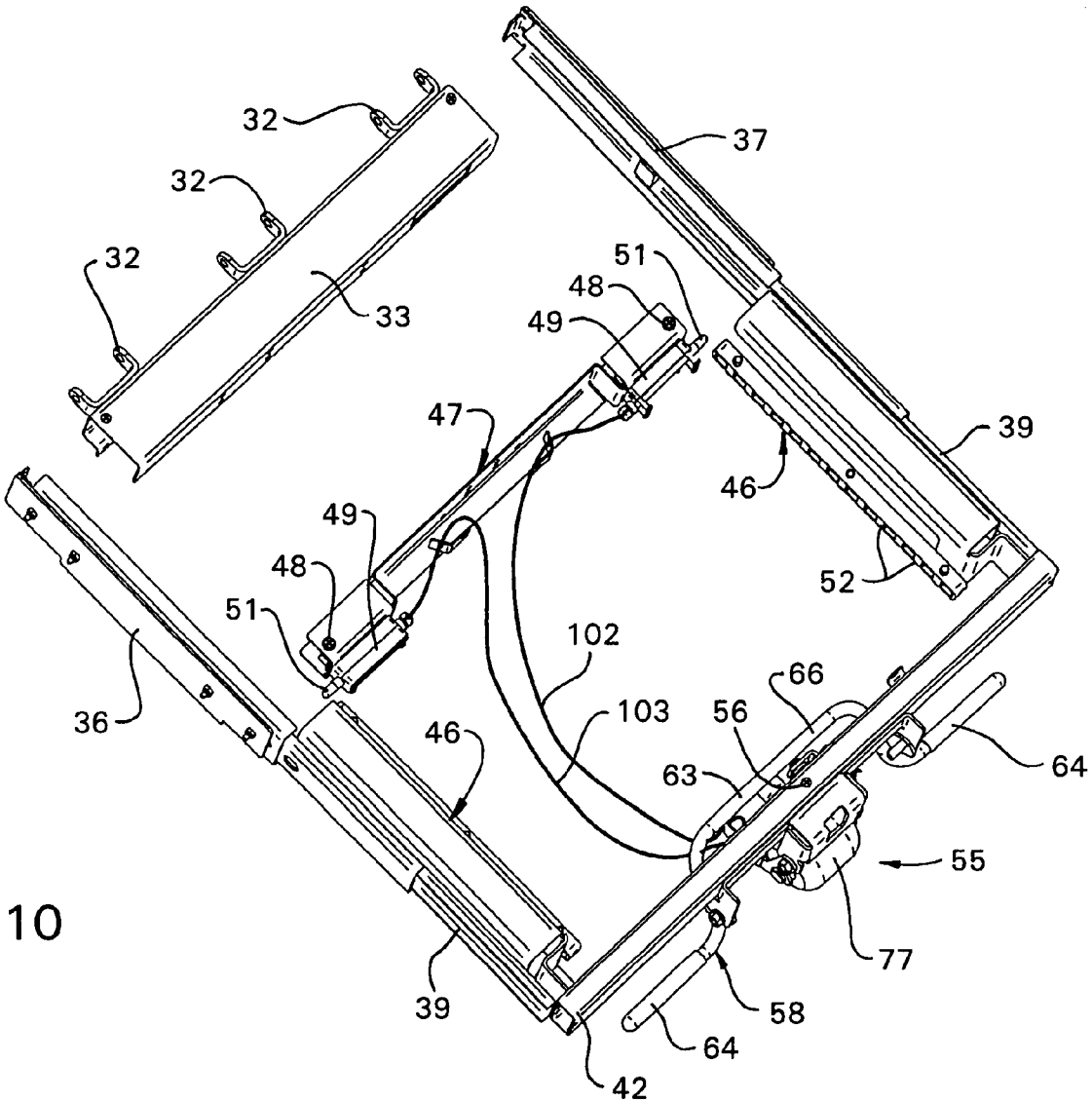
FIG. 10 is an isometric view of the foot end section fully extended.
Figure 12:
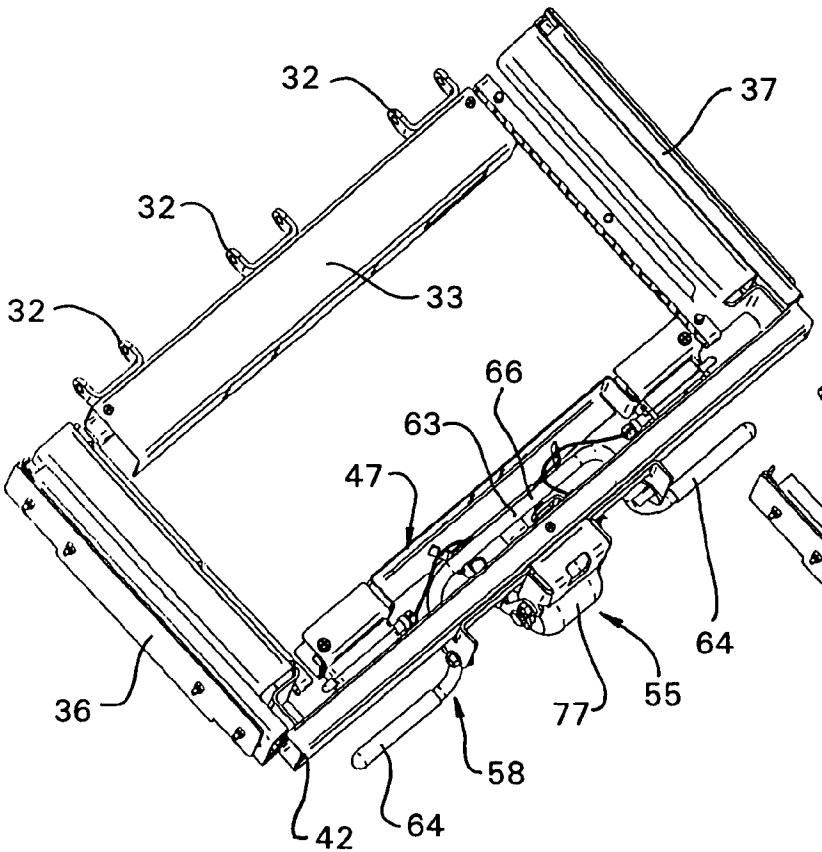
FIG. 12 is an isometric view of the foot section in a fully retracted position.

The foot section 31 includes two separate sections, namely, a first section 33 that is pivotally secured through the hinges 32 to the foot end of the thigh section 26 of the seat section 23 and a second section 34. The first section 33 includes a pair of elongate and extendable guide tracks 36 and 37 (FIG. 10) interconnected by a panel 38 (FIGS. 1 and 2). The second section 34 is mounted on the extendable and retractable portion 39 of each of the elongate guide tracks 36 and 37 so that the second section 34 is supported for movement between an extended position illustrated in FIGS. 1, 2 and 10 and a fully retracted position illustrated in FIG. 12. A panel 41 of the second section 34 is configured to telescope over the panel 38 of the first section 33 in the fully retracted position of the elongate guide tracks 36 and 37 illustrated in FIG. 12. The second section 34 also includes a cross extending brace 42 that interconnects the distal ends of the extendable and retractable portions 39 on each of the guide tracks 36 and 37.

A pair of toothed racks 46 are secured to the underside of the panel 41 and the cross brace 42. The toothed racks 46 extend parallel to one another and to the guide tracks 36 and 37 with plural teeth thereof facing one another. The purpose of these toothed racks 46 will be explained in more detail below.

Figure 11:
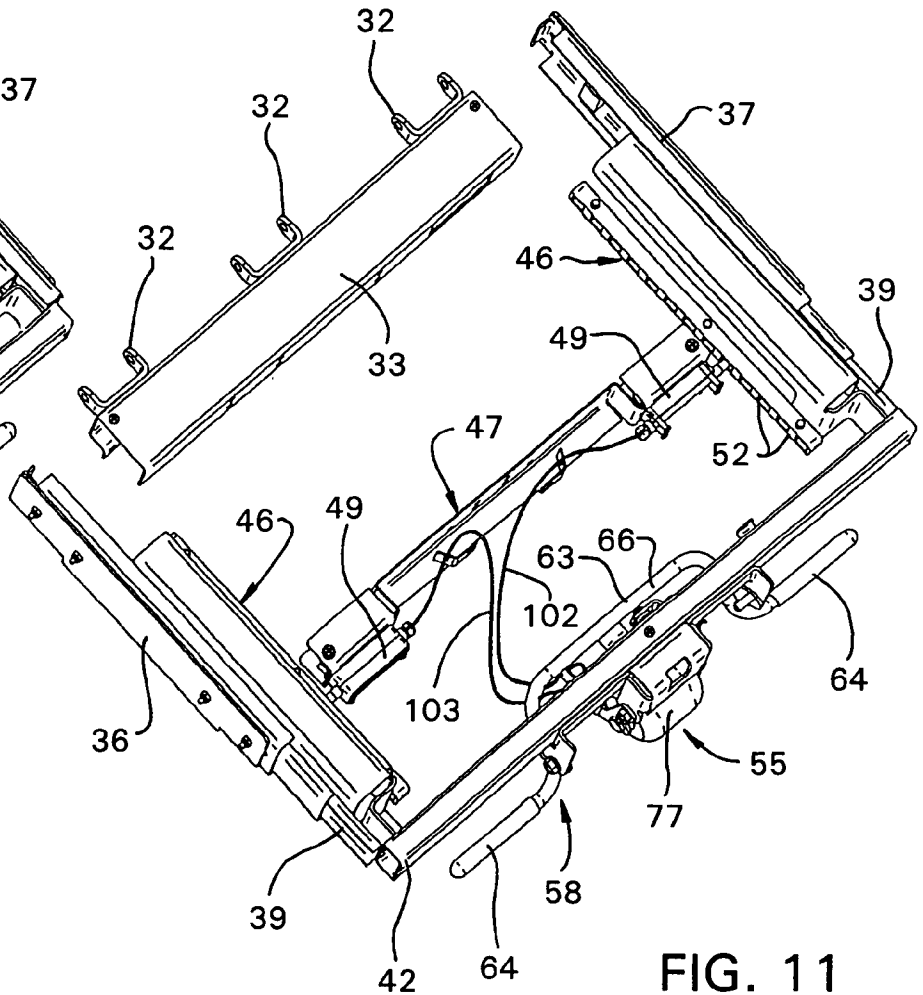
FIG. 11 is an isometric view of the foot section in a partially extended position.

The first section 33 of the foot section 31 includes a bracket 47 (FIG. 10) secured to the underside of the panel 38 by a plurality of any conventional fasteners 48. A reciprocal plunger latch mechanism 49 is mounted to each of the opposite ends of the bracket 47. Each of the reciprocal plunger members 51 of the respective plunger mechanisms is contained in a plane containing the teeth of the toothed racks 46 and are configured to reciprocate within the plane toward and away from the teeth 52 on the toothed racks 46. When the distal end of the plunger members 51 are appropriately seated between mutually adjacent teeth 52 on the toothed racks 46, the second section 34 will be rendered latched by the plunger latch mechanism 49 to the first section 33. FIG. 11 illustrates just such a latched condition. Each plunger member 51 is spring urged by not illustrated springs to an extended position and into meshing engagement between selected teeth 52 on the toothed racks 46.

The second section 34 includes a latch release mechanism 55 mounted on the cross brace 42 by any conventional fastening mechanism 56 in combination with other fastening mechanisms not illustrated. In this particular embodiment, the latch release mechanism 55 (FIG. 5) includes a bracket 57 mounted to the cross brace 42 and pivotally supports a handle 58 at opposite ends thereof. In this particular embodiment, the bracket 57 includes a pair of coaxial pivot axles 59 that are received in aligned holes 61 in brackets 62 secured to the handle 58. The handle is configured in the form of an elongate tube or rod 63 having hand grips 64 at the terminal ends thereof. The brackets 62 are weldably secured to the tube or bar 63. In this particular embodiment, the tube or bar 63 is bent into a U shape with the bight section 66 extending coextensively with the length of the bracket 57 and the legs 67 thereof extending perpendicular thereto with the handle section on which the hand grips 64 are mounted being bent at 90° away from one another relative to the leg sections 67.

Figure 4:
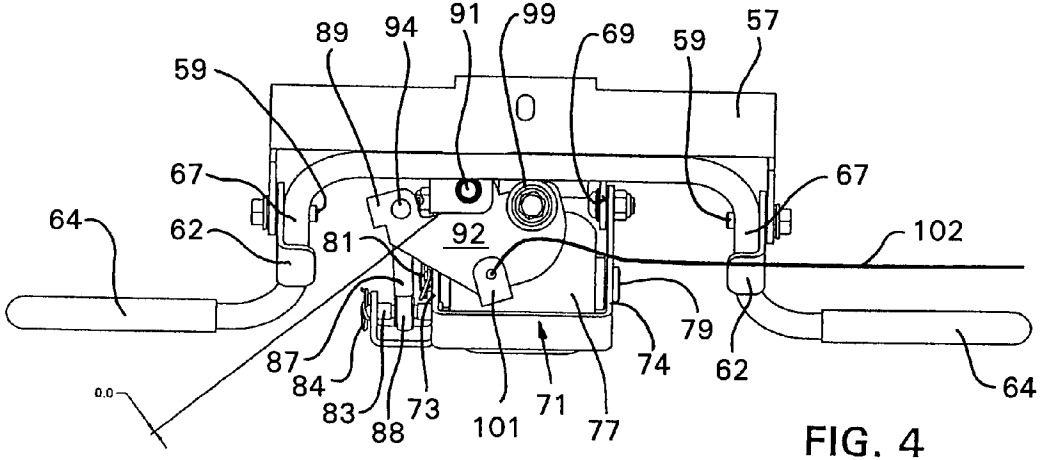
FIG. 4 is a view of the foot end latch mechanism viewed in direction IV illustrated in FIG. 8.
Figure 5:
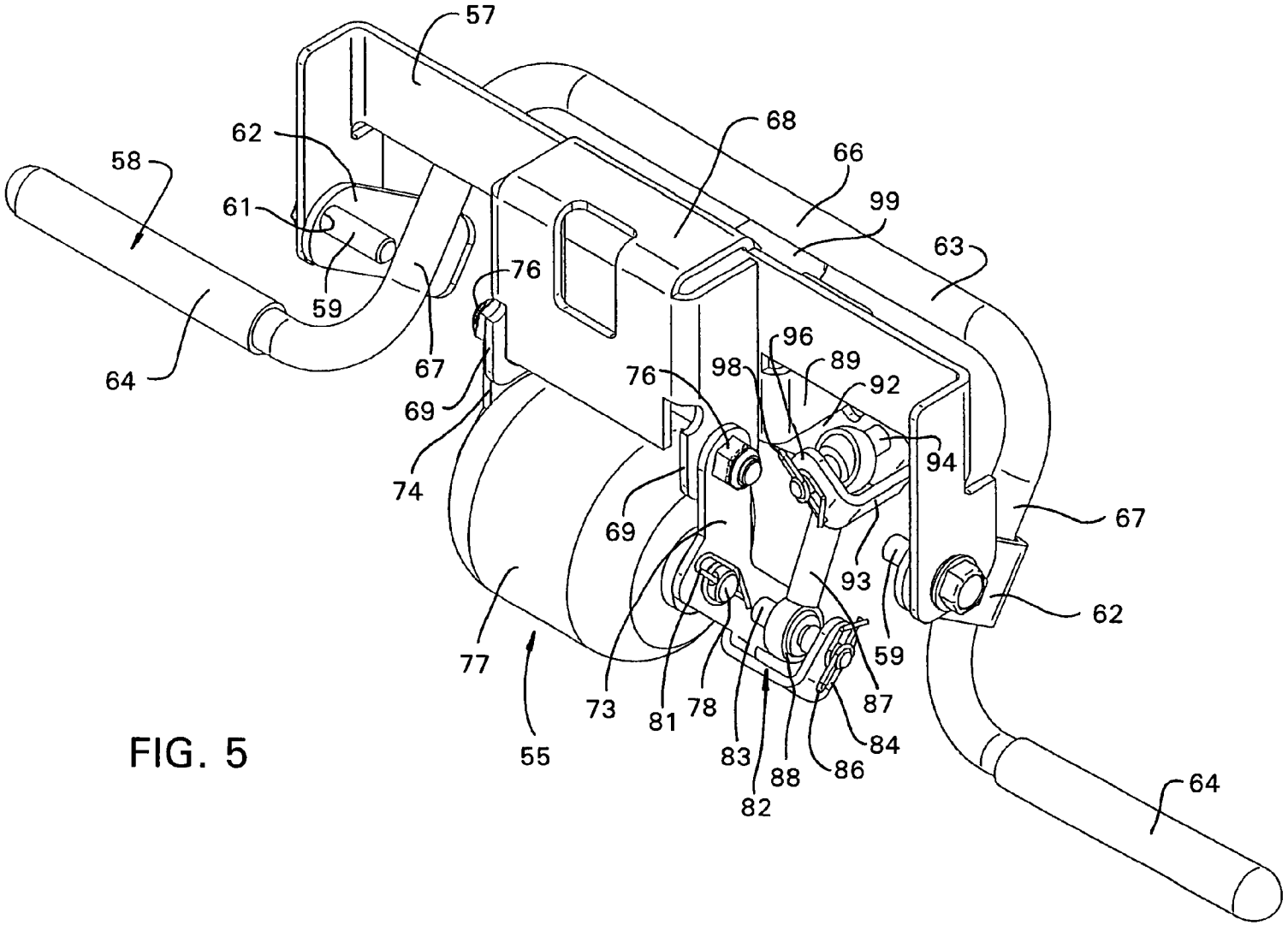
FIG. 5 is an isometric view of the foot end latch mechanism embodying the invention and in a first position thereof.
Figure 6:
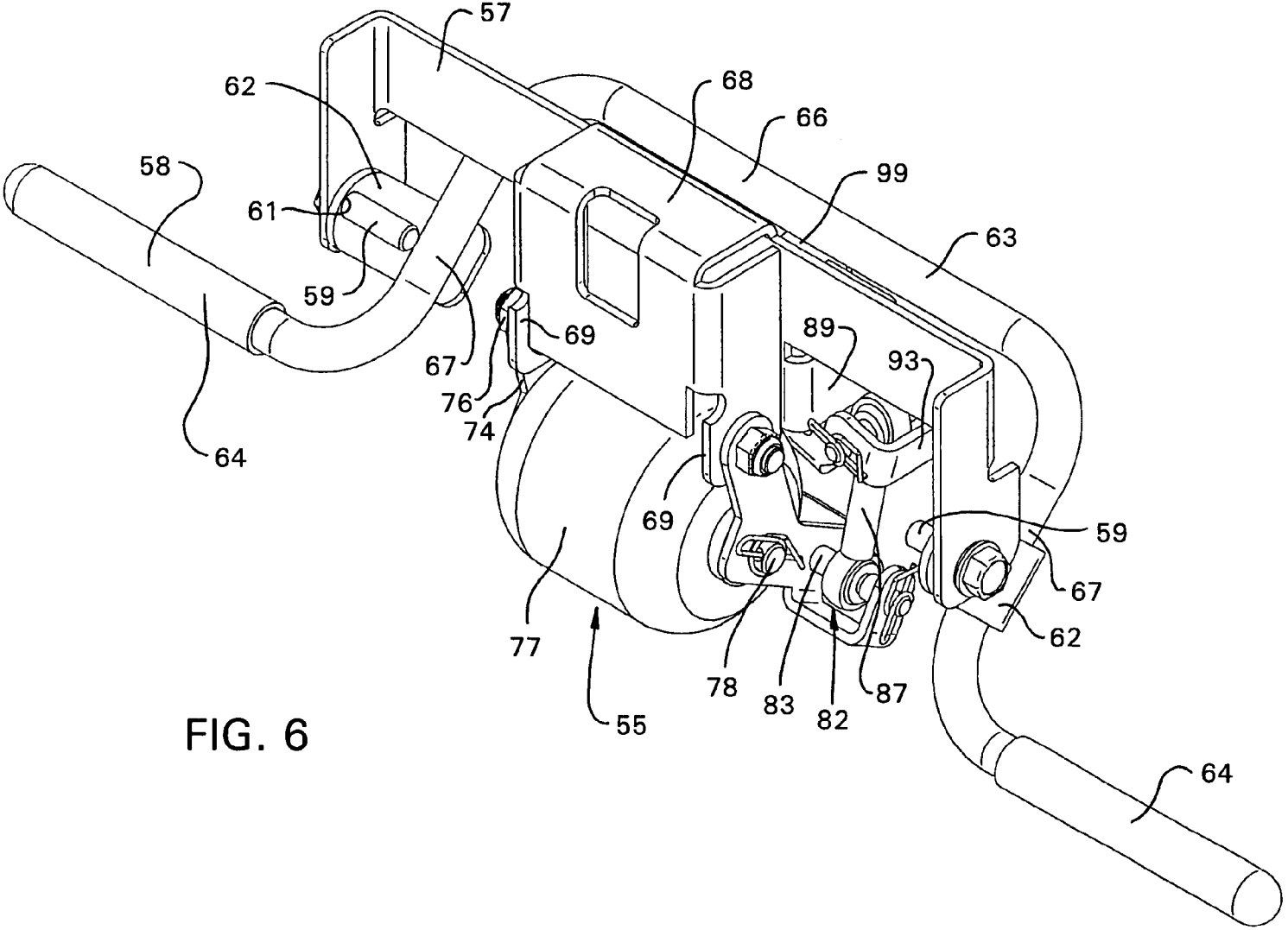
FIG. 6 is a view similar to FIG. 5, but in a second position thereof.

The bracket 57 additionally includes a bracket extension 68, here an integral bracket extension, that includes a pair of parallel legs 69 that are laterally spaced with respect to one another. The legs project downwardly from the bracket extension 68 as illustrated in FIGS. 5 and 6. A U-shaped bracket 71 (FIGS. 3 and 4) has a bight section 72 and a pair of laterally spaced and parallel legs 73 and 74 which are pivotally mounted to respective legs 69 of the bracket extension 68 and by a nut and bolt connection 76 or a comparable rivet connection. A roller is rotatably supported on and between the legs 73 and 74 of the bracket 71 and by an axle 78 received in appropriately axially aligned holes in each of the legs 73 and 74. In this particular embodiment, the axle 78 has an enlarged head 79 (FIGS. 7 and 8) at one end thereof to abut a side face of the leg 74 of the bracket 71. The axle 78 includes a crosswise extending hole adjacent an end remote from the enlarged head 79 into which is received a conventional securement ring 81 or the like as illustrated in FIGS. 5 and 6.

The leg 73 of the bracket 71 includes an auxiliary U-shaped bracket 82 preferably integral therewith and as illustrated in FIGS. 5 and 6. A pin 83 extends through a hole in the leg 73 and between the legs 83 and 84 of the U-shaped bracket 82. In this particular embodiment, one end of the pin 83 includes an enlarged head that abuts a surface of the leg 73 of the bracket 71 and the distal end of the pin includes a hole configured to receive a conventional securement ring 86 therethrough to prevent inadvertent removal of the pin from the auxiliary U-shaped bracket 82.

One end of a link member 87 is secured through a swivel mechanism 88 to the pin 83. The swivel mechanism 88 is configured to permit a pivoting movement of the link member 87 with respect to the pin 83 as well as a small amount of rotary motion of the link with respect to the pin 83.

The bracket 57 (FIGS. 3 and 4) include an additional auxiliary bracket 89 to which is pivotally secured at 91 a plate 92 that is contained in a plane that is generally parallel to an axis of the pin 83. The plate has a U-shaped bracket 93 at the left edge (FIGS. 3 and 4) thereof for supporting a pin 94 that extends between the plate 92 and a leg 96 of the bracket 93. The end of the link member 87 opposite the swivel mechanism 88 has a swivel mechanism 97 and the swivel mechanism 97 is swivelably mounted on the pin 94, the axis of which is generally perpendicular to the plane of the plate 92, as best illustrated in FIGS. 5 and 6. One end of the pin 94 includes an enlarged head that abuts against a surface of the plate 92 while the distal end of the pin has an appropriately provided hole into which is received a conventional securement ring 98 or the like.

A roller 99 (FIGS. 3 and 4) is rotatably mounted on the plate 92 about an axis which is generally perpendicular to the plane of the plate 92 with the outer periphery of the roller 99 engaging the bight section 66 of the tube or bar 63 of the handle mechanism 58.

A bracket 101 (FIGS. 3 and 4) is secured to the plate 92. A pair of cables 102 and 103 are secured at one end to the bracket 101 and at the other end to a respective one of the plunger members 51 of the plunger mechanisms 49. The cables 102 and 103 can be of the bowden cable type effective for transmitting rotary motion of the plate 92 about the pivot support 91 therefor into an effective longitudinal movement to cause a pulling on the respective plunger members 51 away from the teeth 52 on the toothed racks 46 and against the urgings of the return springs on each plunger mechanism 49 to facilitate a release of the latching engagement between the plunger members 51 and the toothed racks 46.

As indicated above, the patient support deck 14 is movable lengthwise of the elongate guide rails 18 and 19 and between positions generally indicated as $P_1$ and $P_2$ in FIGS. 1 and 2. Limit switches 106 and 107 are mounted in any conventional manner on the frame 13 adjacent the aforesaid positions $P_{1\ and\ P2}$ and are configured to send a signal to a control 108 to indicate the presence of a component on the patient support deck 14 and to effect a halting of the drive provided by the actuator 30 which is secured to the carriage 22 as at 30A and configured to drive the carriage 22 lengthwise of the guide rails 18 and 19 due to the connection of the reciprocating driven member 35 thereof to a frame component 40.

Operation

Although the operation of the patient support apparatus described above will be understood from the foregoing description by skilled persons, a summary of such description is now given for convenience.

Figure 14:
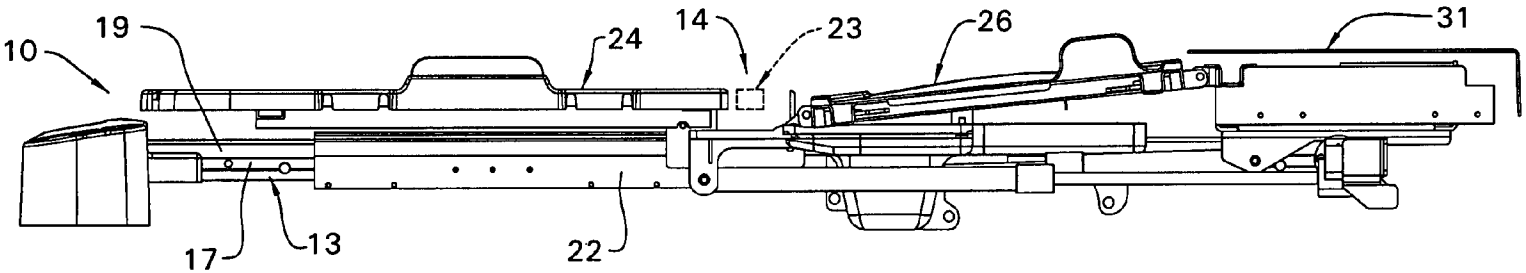
FIG. 14 is a side view of the patient support deck corresponding to FIG. 1.
Figure 13:
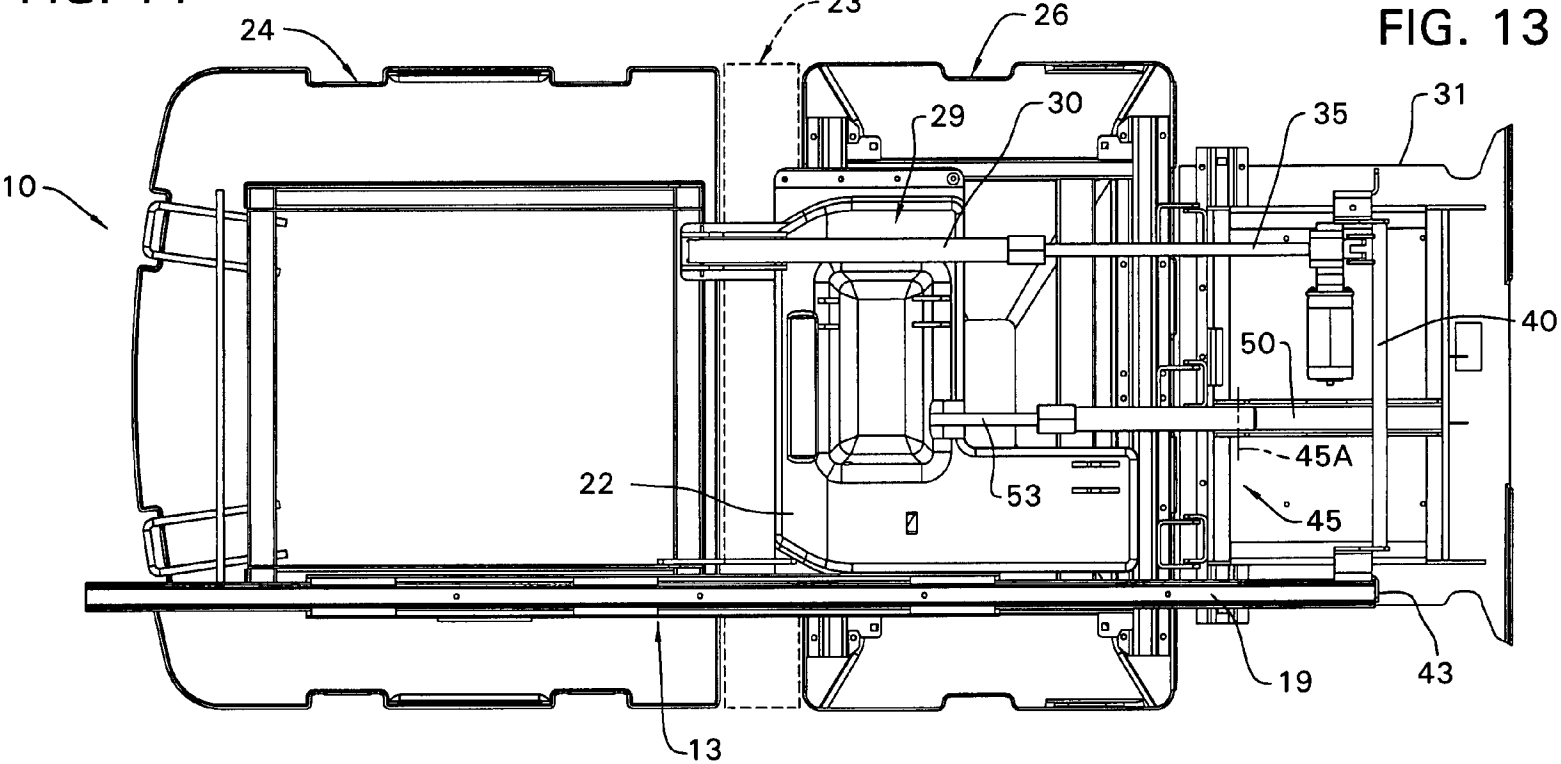
FIG. 13 is a bottom view (corresponding to FIG. 1) of the frame that supports the patient support deck.
Figure 15:
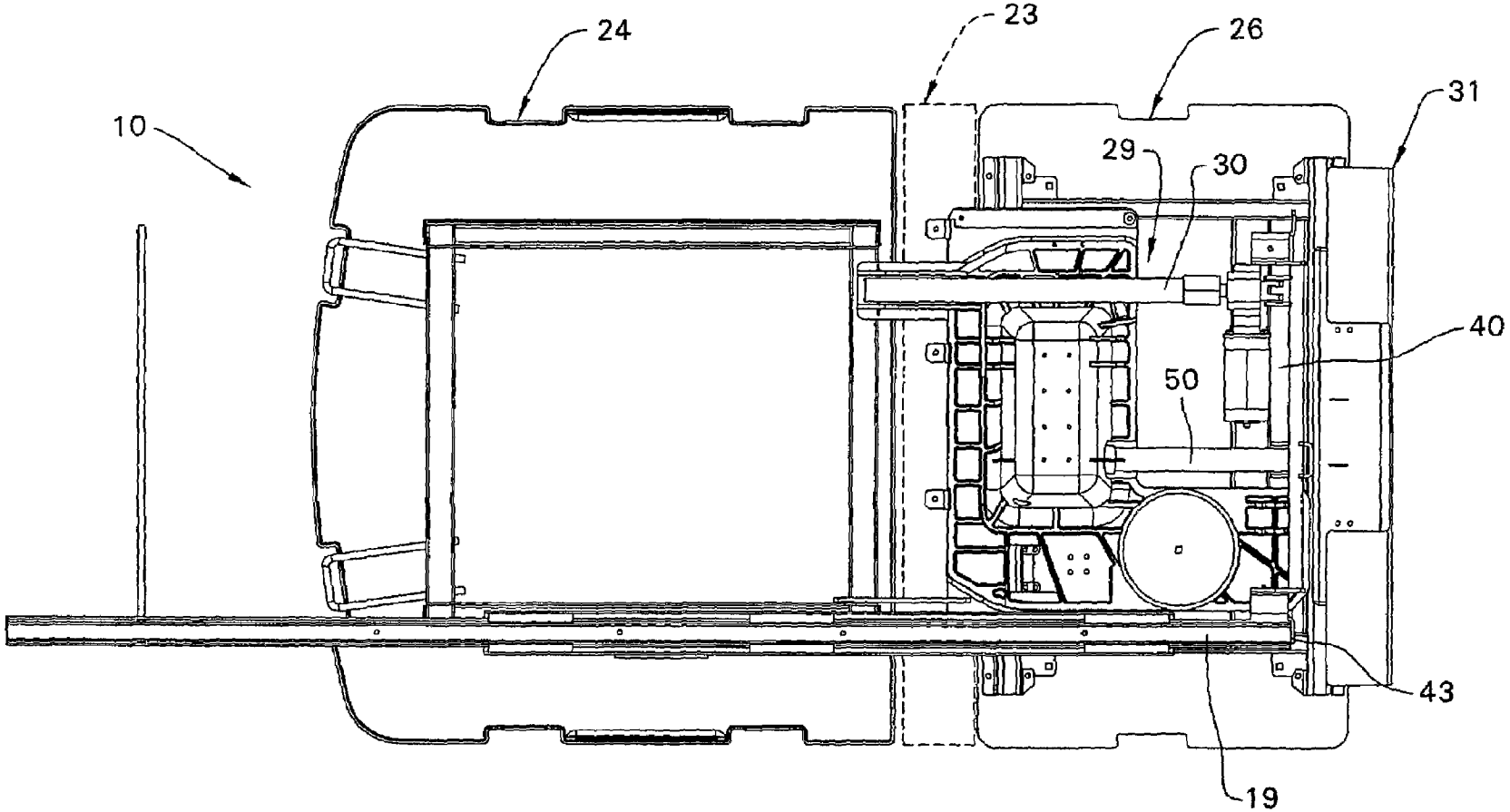
FIG. 15 is a bottom view (corresponding to FIG. 2) of the frame that supports the patient support deck.

When the patient support deck 14 is in the position illustrated in FIGS. 1 and 13, the carriage 22 is supported on the elongate guide rails 18 and 19. Furthermore, the carriage 22 is in the position $P_1$. Thus, upon activation of the actuator 29 by a not illustrated attendant and/or patient operated switch, the carriage 22 is driven rightwardly from the position $P_1$ toward the position $P_2$. As this movement occurs, the elongation sensor 44 will send signals to the control 108 continuously indicating the position of the carriage 22 on the guide rails 18 and 19. Each position so monitored will be compared to an angle indication from the inclinometer 54 and, if appropriate, effect an activation of the actuator 44 to cause a corresponding pivoting of the foot section 31 about the hinges 32. In the instance where the carriage 22 is moving rightwardly away from the position $P_1$, the driven member 50 of the actuator 45 would be caused by the control 108 to retract to cause the foot section to eventually become oriented in a vertical plane when the carriage 22 reaches position $P_2$ as shown in FIGS. 2 and 14. The coordination of the elongation sensor 44 and the inclinometer 54 performed by the control 108 assures that the foot section 31 will be driven in a way to prevent contact with the foot ends 43 of the guide rails 18 and 19 as well as the guide rails themselves. The movement of the carriage 22 will continue to the right until the carriage 22 reaches the position $P_2$ at which point the limit switch 107 will send a signal to the control 108 to halt the provision of driving power to the actuator 30 on the carriage 22.

Figure 9:
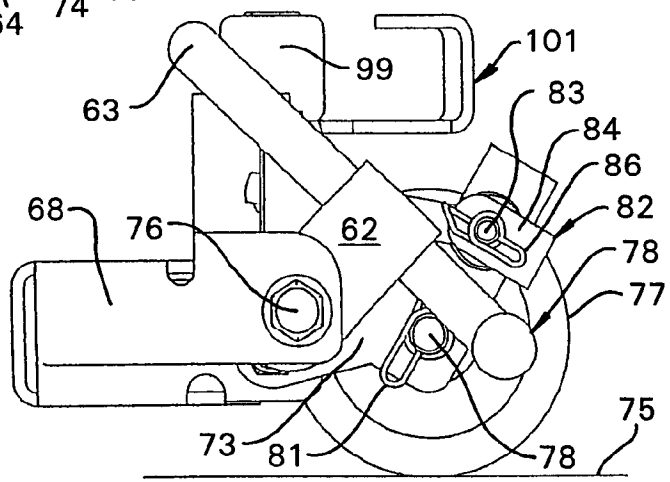
FIG. 9 is a side view of the latch mechanism viewed from the opposite side of FIGS. 7 and 8 and in the unlatched position due to floor engagement.

If the height of the patient support 14 is sufficiently high as illustrated in FIG. 2, the foot section 31 will be able to pivot to the generally vertical position illustrated in FIG. 2, namely, with the second section 34 of the foot section 31 being in the fully extended position. However, if the height of the patient support deck is lower due to the jacks 12 being in a retracted condition, the roller 77 (FIG. 5) will come into contact with the floor surface as the foot section 31 transitions toward the generally vertical position. As the roller 77 engages the floor surface 75, as depicted in FIG. 9, it will cause a pivoting of the U-shaped bracket 73 about the axle provided by the nut and bolt or rivet connection 76 in a generally counterclockwise direction (FIG. 5) to effect a movement of the auxiliary U-shaped bracket 82 upwardly to thence cause the plate 92 to rotate about its respective pivot 91 clockwise from the position illustrated in FIG. 3 to the position illustrated in FIG. 4. Such movement will effect a pulling force on the bowden cables 102 and 103 to effect a pulling of the plunger members 51 away from the teeth 52 on the racks 46 to effect a releasing of the latching engagement between the second section 34 and first section 33 of the foot section 31. As a result, a continued movement of the foot section 31 toward the generally vertical position is permitted due to the ability of the second section 34 to telescope over the first section 33 toward the hinges 32. This enables the height of the seat section components 23 and 26 to be sufficiently lowered to facilitate bed exit by the patient at the foot end of the bed.

Figure 3:
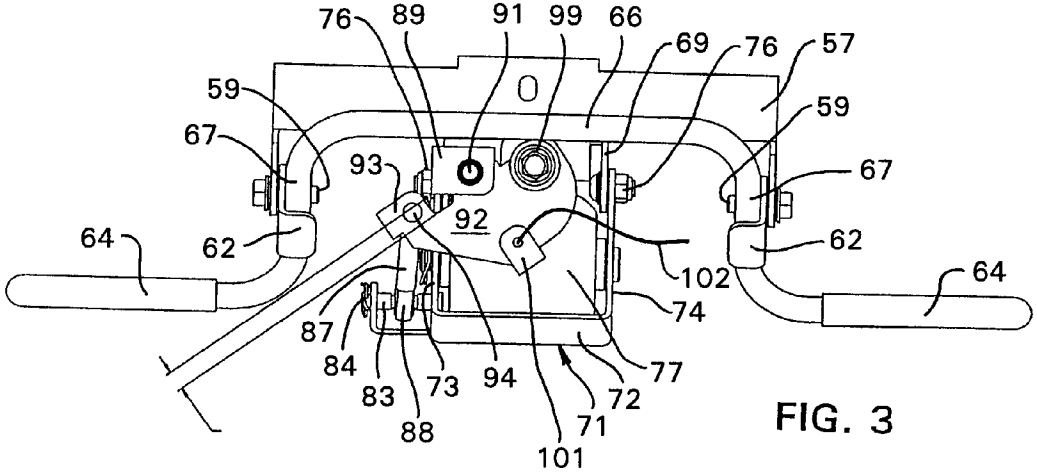
FIG. 3 is a view of the foot end latch mechanism viewed from direction III illustrated in FIG. 7.
Figure 8:
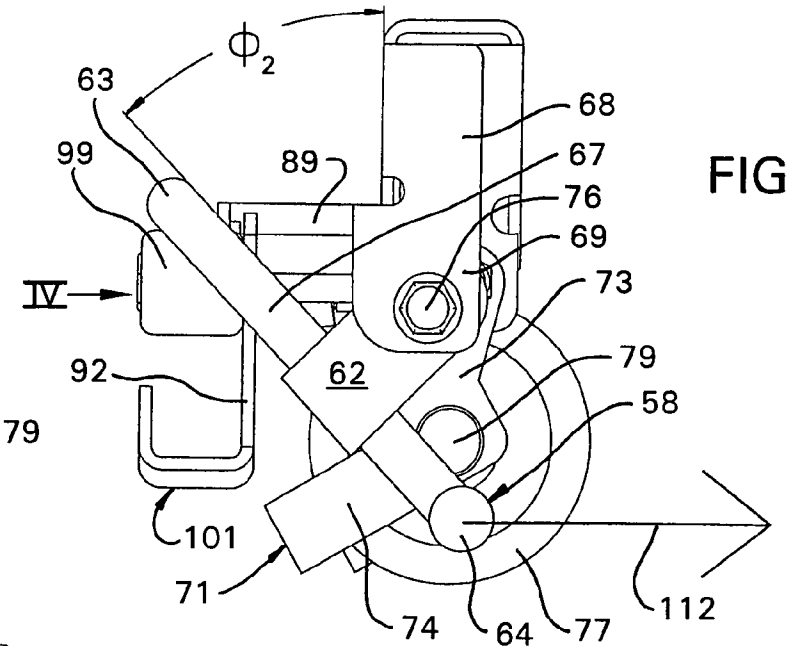
FIG. 8 is a side view of the foot end latch mechanism in the unlatched position.
Figure 7:
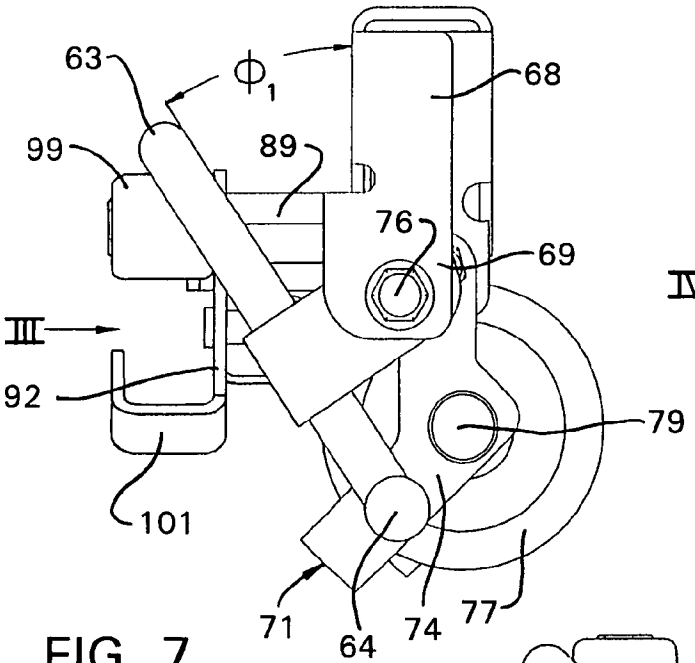
FIG. 7 is a side view of the foot end latch mechanism in the latched position.

When the patient support deck 14 is in the position illustrated in FIG. 1 and it is desired to move the patient support apparatus 10 from one location to another, it is oftentimes desired to shorten the length of the bed to facilitate a movement thereof onto elevators, as well as into and out of the rooms in a patient care facility. The manually engageable handle mechanism 58 is provided at the foot end of the second section 34 to permit a manual disengagement of the latch mechanism provided by the plunger mechanisms 49. Referring to FIGS. 7 and 8, a movement of the handle mechanism 58 and particularly the handle grips 64 thereof to the right in direction of the arrow 112 will cause the tube or bar 63 to pivot between the angles $\phi_1$ and $\phi_2$ to cause the bight section 66 to push downwardly on the roller 99 rotatably secured to the plate 62. As illustrated in FIGS. 3 and 4, a downward force on the roller 99 caused by the bight section 66 will urge the plate 92 clockwise about its pivot support 91 to effect, as aforesaid, a withdrawal of the plunger members 51 from the teeth 52 on the toothed racks 46 to thereby enable a manual force to be applied to the second section 34 of the foot section 31 to move it with respect to the first section 33 toward and/or away from the hinges 32.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A patient support apparatus, comprising:

an elongate frame having a head end, a foot end and lateral sides;

a patient support deck mounted on said frame, said patient support deck including a head section, a seat section and a foot section, said foot section including first and second sections;

a hinge assembly interconnecting said seat section and said first section and for pivotally supporting said first section for movement to and between a generally horizontal position and a generally vertical position;

an extendible and retractable track assembly for supporting said second section on said first section and for movement between an extended position wherein said foot section has a longest dimension and a retracted position wherein said foot section has a shortest dimension;

a latch mechanism configured to latch said second extension to said first extension; and a floor engaging latch release mechanism configured to effect an unlatching of said latch mechanism in response to an engagement thereof with a floor surface on which said patient support apparatus is supported and permit a relative movement between said first and second sections as said foot section transitions between said generally horizontal position and said generally vertical position.

2. The patient support apparatus according to claim 1, wherein said latch mechanism further includes a handle mechanism configured to facilitate a release of said latch mechanism in response to a manual manipulation of said handle mechanism and when said floor engaging latch release mechanism is out of engagement with said floor surface.

3. The patient support apparatus according to claim 1, wherein said floor engaging latch release mechanism includes a bracket having a section mounted on said second section and an articulatable section movable with respect thereto, a wheel rotatably mounted on said articulatable section; and a first linkage mechanism connected to and extending between said articulatable section and said latch mechanism, said articulatable section being articulatable in response to said wheel engaging the floor surface to effect said unlatching of said latch mechanism as said foot section transitions between said generally horizontal position and said generally vertical position.

4. The patient support apparatus according to claim 1, wherein said latch mechanism further includes a handle mechanism configured to facilitate a release of said latch mechanism in response to a manual manipulation of said handle mechanism and when said floor engaging latch release mechanism is out of engagement with said floor surface; and wherein said floor engaging latch release mechanism includes a bracket having a section mounted on said second section and an articulatable section movable with respect thereto, a wheel rotatably mounted on said articulatable section; and a first linkage mechanism connected to and extending between said articulatable section and said latch mechanism, said articulatable section being articulatable in response to said wheel engaging the floor surface to effect said unlatching of said latch mechanism as said foot section transitions between said generally horizontal position and said generally vertical position, said handle mechanism including a second linkage mechanism connected to said articulatable section of said bracket.

5. The patient support apparatus according to claim 4, wherein said second linkage mechanism includes an operator member movably mounted on said articulatable section and having a portion interfaced with said handle mechanism and configured so that a movement of said handle mechanism will effect a movement of said operator member, one end of said first linkage being fastened to said operator member and configured to operate said latch mechanism in response to said movement of said operator member.

6. The patient support apparatus according to claim 5, wherein said first linkage further includes a link connected to and extending between said operator member and said articulatable section and configured so that a movement of said articulated section in response to said wheel engaging the floor surface will effect a movement of said operator member to operate said latch mechanism independent of a manual manipulation of said handle mechanism.

7. The patient support apparatus according to claim 1, wherein said elongate frame includes an elongate guide assembly extending lengthwise thereof, said patient support deck including a carriage mounted on said guide assembly and supported for lengthwise movement with respect thereto, and an actuator for driving said carriage lengthwise with respect to said guide assembly.

8. The patient support apparatus according to claim 7, wherein said frame includes plural movement limiting mechanisms for defining the terminal positions to which said patient support deck and said carriage therefor will move in response to said actuator driving movement.

9. The patient support apparatus according to claim 8, wherein a first of said plural movement limiting mechanisms is configured to locate said carriage at a first position on said guide assembly.

10. The patient support apparatus according to claim 9, wherein a second of said plural movement limiting mechanisms is configured to locate said carriage at a second position on said guide assembly and said foot section extends beyond said guide assembly.

11. The patient support apparatus according to claim 10, wherein said latch mechanism further includes a handle mechanism configured to facilitate a release of said latch mechanism in response to a manual manipulation of said handle mechanism and when said floor engaging latch release mechanism is out of engagement with said floor surface.

12. The patient support apparatus according to claim 10, wherein said floor engaging latch release mechanism includes a bracket having a section mounted on said second section and an articulatable section movable with respect thereto, a wheel rotatably mounted on said articulatable section; and a first linkage mechanism connected to and extending between said articulatable section and said latch mechanism, said articulatable section being articulatable in response to said wheel engaging the floor surface to effect said unlatching of said latch mechanism as said foot section transitions between said generally horizontal position and said generally vertical position.

13. The patient support apparatus according to claim 10, wherein said latch mechanism further includes a handle mechanism configured to facilitate a release of said latch mechanism in response to a manual manipulation of said handle mechanism and when said floor engaging latch release mechanism is out of engagement with said floor surface; and wherein said floor engaging latch release mechanism includes a bracket having a section mounted on said second section and an articulatable section movable with respect thereto, a wheel rotatably mounted on said articulatable section; and a first linkage mechanism connected to and extending between said articulatable section and said latch mechanism, said articulatable section being articulatable in response to said wheel engaging the floor surface to effect said unlatching of said latch mechanism as said foot section transitions between said generally horizontal position and said generally vertical position, said handle mechanism including a second linkage mechanism connected to said articulatable section of said bracket.

14. The patient support apparatus according to claim 13, wherein said second linkage mechanism includes an operator member movably mounted on said second section and having a portion interfaced with said handle mechanism and configured so that a movement of said handle mechanism will effect a movement of said operator member, one end of said first linkage being fastened to said operator member and configured to operate said latch mechanism in response to said movement of said operator member.

15. The patient support apparatus according to claim 14, wherein said first linkage further includes a link connected to and extending between said operator member and said articulatable section and configured so that a movement of said articulated section in response to said wheel engaging the floor surface will effect a movement of said operator member to operate said latch mechanism independent of a manual manipulation of said handle mechanism.

16. The patient support apparatus according to claim 7, wherein said patient support deck includes a further actuator for driving said foot section about said hinge assembly, a first sensor for monitoring the position of said patient support deck relative to said guide assembly, a second sensor for monitoring an angle of inclination of said foot section relative to a horizontal, and a control for coordinating signals produced by said first and second sensors to prevent structural interference as said foot section is moved between positions about said hinge assembly.

* * * * *